US007828579B2

(12) United States Patent
Huang

(10) Patent No.: US 7,828,579 B2
(45) Date of Patent: Nov. 9, 2010

(54) LATCH LOCKING TYPE CONNECTOR

(75) Inventor: Yu-Cheng Huang, Lujhu Township, Taoyuan County (TW)

(73) Assignee: Kingconn Technology Co., Ltd., Taoyuan County (TW)

( * ) Notice: Subject to any disclaimer, the term of this patent is extended or adjusted under 35 U.S.C. 154(b) by 0 days.

(21) Appl. No.: 11/892,953

(22) Filed: Aug. 28, 2007

(65) Prior Publication Data

US 2010/0216325 A1 Aug. 26, 2010

(51) Int. Cl.
*H01R 13/627* (2006.01)

(52) U.S. Cl. ..... 439/352; 439/155

(58) Field of Classification Search ..... 439/296, 439/155, 345, 350, 352–354, 356–358
See application file for complete search history.

(56) References Cited

U.S. PATENT DOCUMENTS 6,454,577 B1 * 9/2002 Yi ..... 439/108
7,160,135 B1 * 1/2007 Wu ..... 439/352
7,207,823 B1 * 4/2007 Yang ..... 439/352
7,238,040 B1 * 7/2007 Wu ..... 439/352
7,281,937 B2 * 10/2007 Reed et al. ..... 439/352
7,318,740 B1 * 1/2008 Henry et al. ..... 439/352
7,354,292 B1 * 4/2008 Lloyd et al. ..... 439/352
7,445,484 B2 * 11/2008 Wu ..... 439/352
2007/0243749 A1 * 10/2007 Wu ..... 439/352

* cited by examiner

*Primary Examiner*—Michael C Zarroli
(74) *Attorney, Agent, or Firm*—Jackson IPG PLLC; Demian K. Jackson

(57) ABSTRACT

A latch locking type connector has one elastic cantilever and an actuation plate respectively disposed with an inclined plate and a slide corresponding to each other. The upward movement of the inclined plate resulting from the sliding contact of the slide and the inclined plate raises a free end of the elastic cantilever to separate a connector casing from a lead frame. The elastic cantilever pushes and contacts in an opposite direction to return the actuation plate to its original place while allowing a free end of the elastic cantilever to return to its normal position to produce an expected latch locking function when the connector casing and the lead frame are connected to each other once again.

9 Claims, 5 Drawing Sheets

LATCH LOCKING TYPE CONNECTOR

BACKGROUND OF THE INVENTION (a) Field of the Invention

The present invention is related to a latch locking type connector, and more particularly, to a structure of latch locking connector that is capable of constantly maintaining its expected locking function.

(b) Description of the Prior Art

A connector is usually applied to realize telecommunication linkage between two parts in many circuit configurations of electric installations essentially by taking advantage of plug in and out features of the connector to facilitate electric connection between two parts and service or replacement of the parts in future. Therefore, to any connector permitting relative connection, a lead frame and a connector casing that are respectively disposed on both parts it connects must be provided.

Wherein, both of the lead frame and the casing of the connector are usually directly soldered to the circuit boards of parts they are respectively connected to, or further connected by means of transmission cables to circuits of those parts they are respectively connected to, or even directly fixed to flexible printed circuits of the parts they are connected to for taking advantage of flexibility provided by the transmission cable or FPC to realize improved convenience.

Furthermore, the extremely convenient feature of plug in and out of the connector presents at the same time the risk of telecommunication link failure resulted from the undesired separation of the casing of the connector and the lead frame. Accordingly, a locking mechanism to improve combination strength of the connector casing and the lead frame is further disposed to many types of connector. A latch locking type connector such as a short and small type of latch locking type of connector as disclosed in No. M302158 published in Taiwan Gazette is essentially comprised of an elastic cantilever and an actuation plate on a casing of the connector. A linking hook disposed on a free end of the elastic cantilever extends into a locking hole disposed on top of a lead frame so to prevent the casing of the connector to come apart from the lead frame.

When a user is pulling the actuation plate a slope on a root of an abutting end of the connector casing lifts up the actuation plate to push against the free end of the cantilever to raise the linking hook at the free end of the elastic cantilever to exit from the locking hole on the lead frame and, thus, to free both of the connector casing and the lead frame. However, an expansion cam portion disposed at a rear of the actuation plate is forced to wedge in between the elastic cantilever and the connector casing to push and raise the free end of the elastic cantilever in the latch locking type connector. As a result, the expansion cam at the rear of the actuation plate remains to be held between the elastic cantilever and the connector casing after the user has started an actuator to prevent the free end of the elastic cantilever from returning to its normal position, thus failing to produce the latch locking function as expected when the latch locking type connector needs to be connected once again.

SUMMARY OF THE INVENTION

The primary purpose of the present invention is to provide a latch locking type connector that is capable of maintaining its expected latch locking function when a casing of the connector is connected to a lead frame once again.

To achieve the purpose, an inclined plate and a slide are respectively disposed to correspond to an elastic cantilever and an actuation plate; upward movement of the inclined plate resulting from the sliding contact of the slide and the inclined plate raises a free end of the elastic cantilever for a linking hook disposed at the free end of the elastic cantilever to exit from a locking hole provided on the lead frame so that the casing of the connector comes apart from the lead frame. Elasticity of the elastic cantilever works in an opposite direction to push the actuator plate to return to its original place while returning the free end of the elastic cantilever to its normal position when a user releases the actuator plate. Accordingly, when both of the connector casing and the lead frame are joined to each other once again, the expected latch locking function can be immediately produced.

DETAILED DESCRIPTION OF THE PREFERRED EMBODIMENTS

Figure 1:
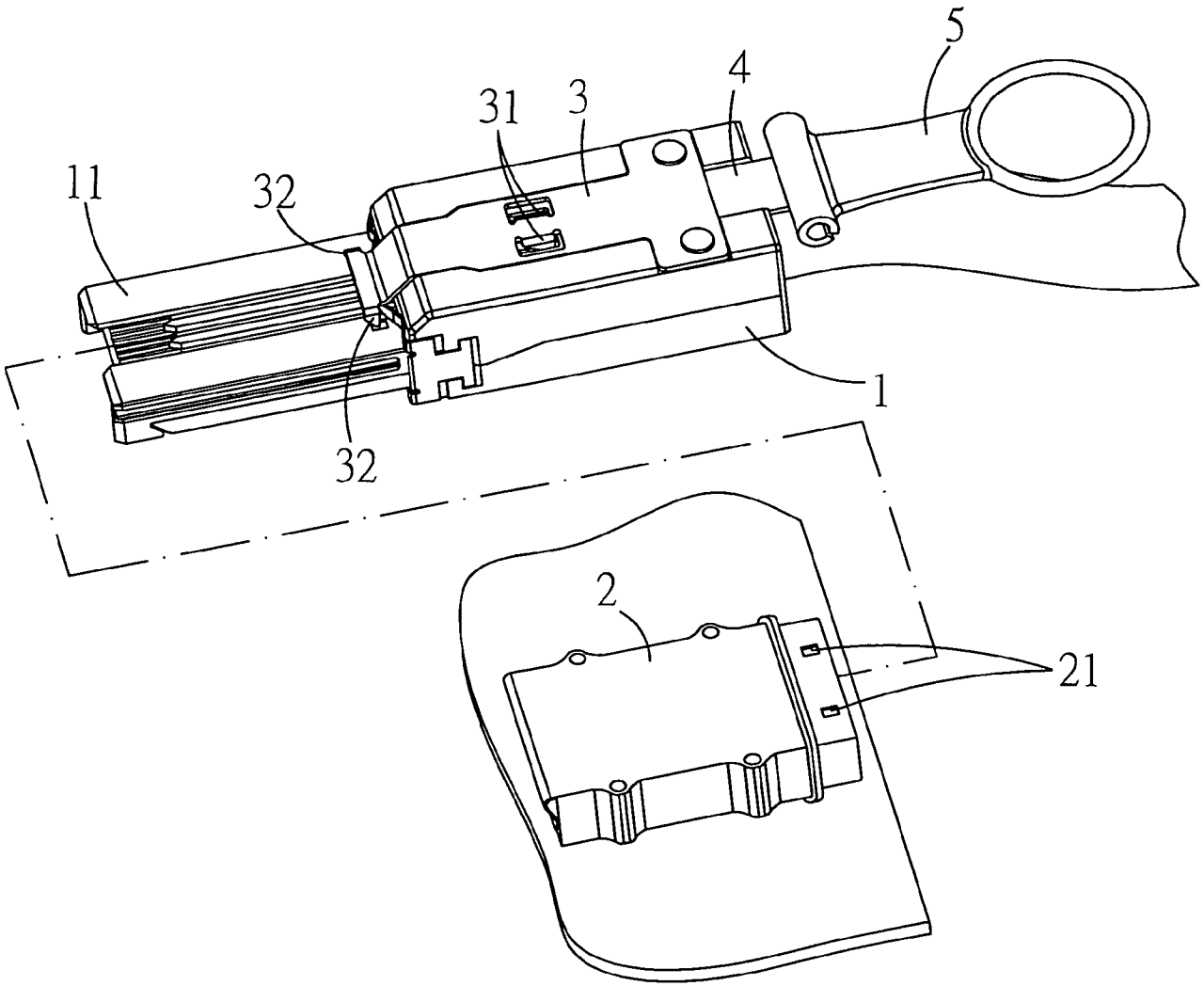
FIG. 1 is a perspective view of the present invention.
Figure 2:
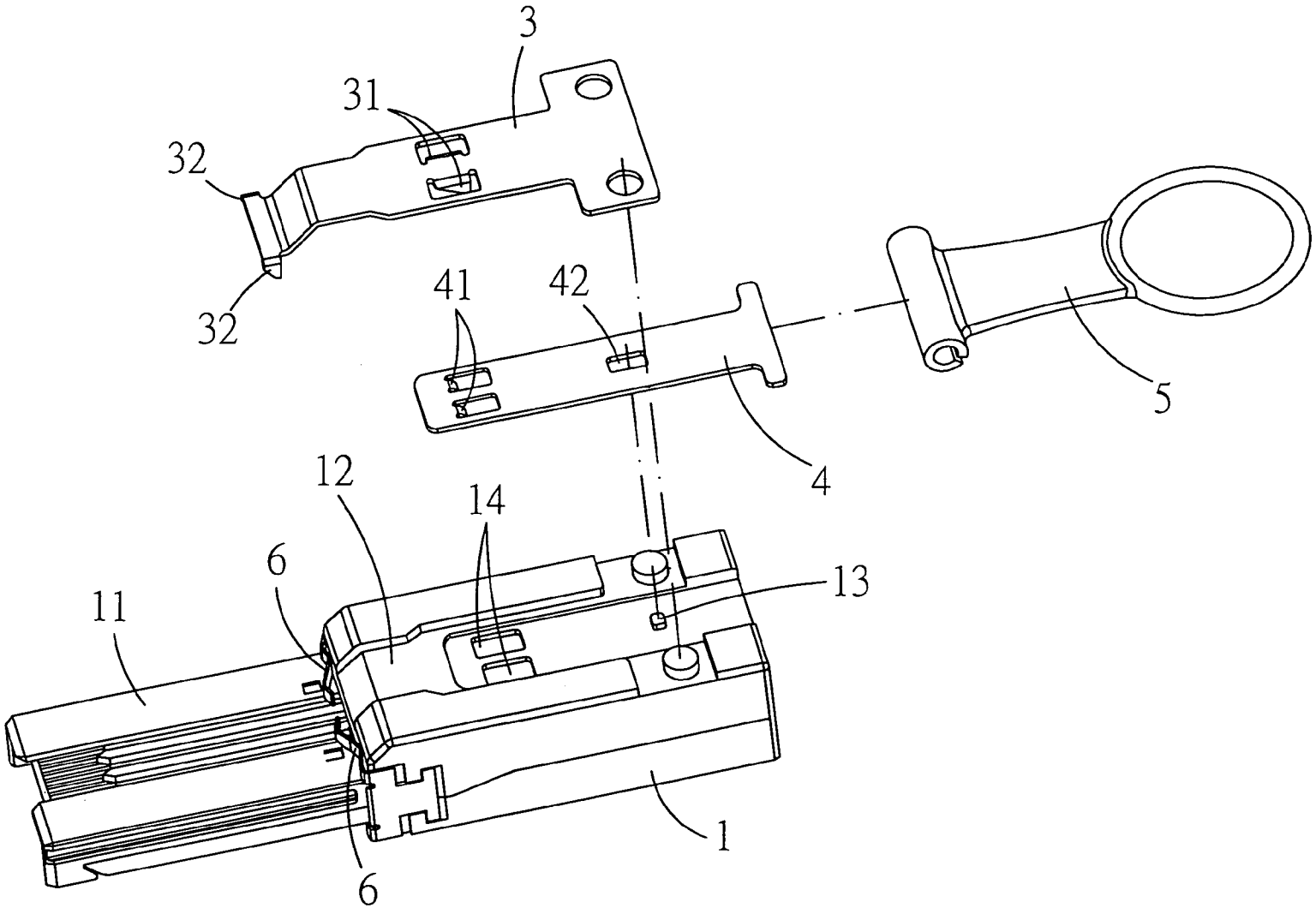
FIG. 2 is an exploded view of the present invention showing a structure among a connector casing, an elastic cantilever, and an actuation plate.

The primary purpose of the present invention is to provide a latch locking type connector that is capable of constantly maintaining its locking function as expected. Referring to FIGS. 1 and 2, the connector is comprised of a connector casing 1 and a lead frame that can be abutted to each other, an elastic cantilever 3, and an actuation plate 4. Wherein, the connector casing 1 is disposed with an abutting end 11 to be relatively inserted into the lead frame 2, one or a plurality of locking hole 21 is disposed on a top of the lead frame 2; a fixed end of the elastic cantilever 3 is fixed to the connector casing 1; and an elastic end of the elastic cantilever 3 relatively extends toward the abutting end 11 of the connector casing 1. One or a plurality of inclined plate 31 is disposed on a body of the elastic cantilever 3 and a linking hook 32 corresponding to the locking hole 21 is disposed on the elastic end of the elastic cantilever 3. The linking hook 32 extends into the locking hole as illustrated in FIG. 3 to prevent the connector casing 1 coming apart from the lead frame 2.

The actuator plate 4 is disposed between the connector casing 1 and the elastic cantilever 3 with one end of the actuation plate 4 extending out of the connector casing 1 and is connected to a pull ring 5 to facilitate pulling by a user thus to realize relative sliding by the actuation plate 4 and the elastic cantilever 3. A slide 41 is disposed on the body of the actuation plate corresponding to the inclined plate 31 of the elastic cantilever 3. Upward movement of the inclined plate resulting from the sliding contact of the slide 41 and the inclined plate 31 raises a free end of the elastic cantilever 3 to exit the linking hook 32 out of the locking hole 21 as illustrated in FIG. 4 to thus disengage the connector casing 1 from the lead frame 2.

Whereas both the inclined plate 31 and the slide 41 respectively disposed on the elastic cantilever 3 and the actuation plate 4 of the entire latch locking type connector raise the free end of the elastic cantilever essentially by taking advantage of force exerted by both of the slide 41 and the inclined plate 31 to cause the linking hook 32 disposed on the free end of the elastic cantilever to exit from the locking hole 21 of the lead frame. Elastic force from the elastic cantilever 3 pushes and contacts in an opposite direction so that the actuation plate 4 returns to its original position which allows the free end of the elastic cantilever 3 to return to its normal position when the user releases the actuation plate 4. Accordingly, when the connector case 1 is connected once again to the lead frame 2, the expected locking function is immediately produced.

Figure 3:
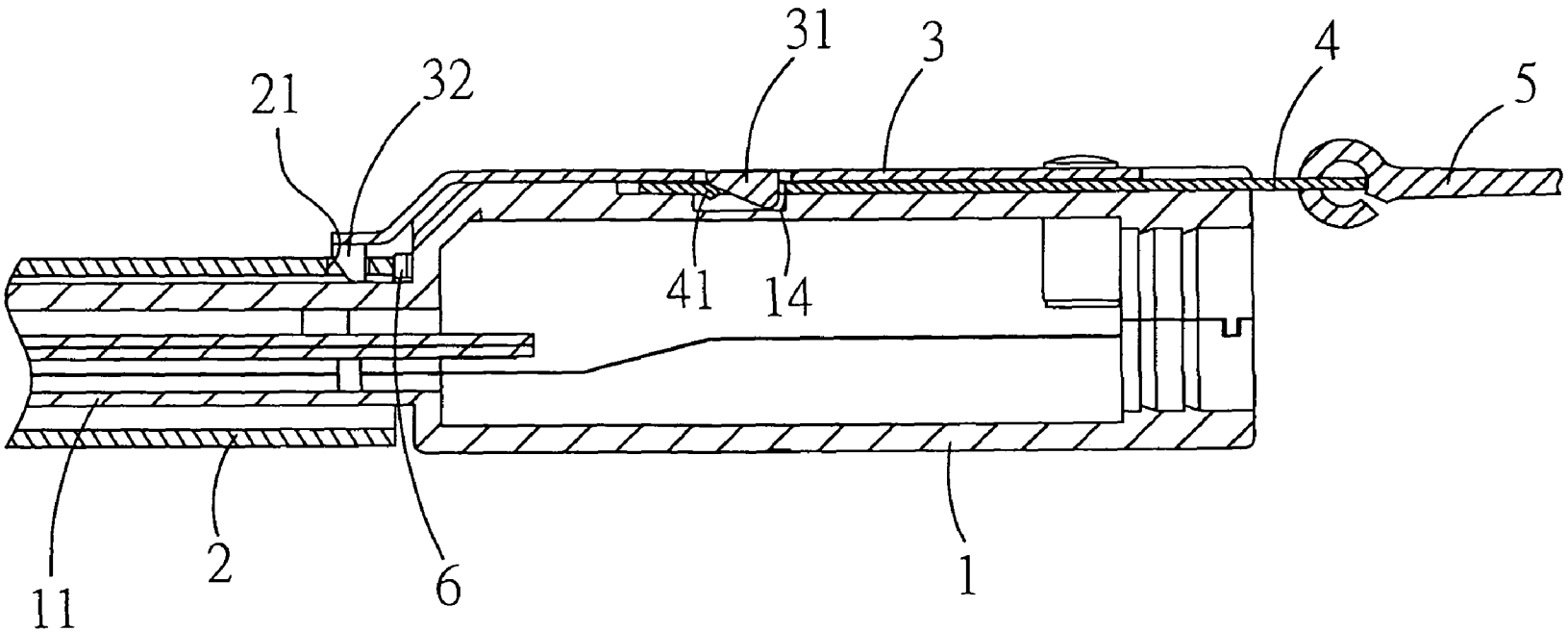
FIG. 3 is a sectional view showing a structure of the present invention when a latch locking type connector is in its locked status.

Furthermore, one or a plurality of ejector 6 is disposed at a root of the abutting end 11 of the connector casing 1 to produce a force to disengage the connector casing 1 from the lead frame 2 as illustrated in FIG. 3. When the abutting end 11 of the connector casing 1 is inserted into the lead frame 2 and secured in position, the linking hook 32 from the elastic cantilever 3 is locked into the locking hole 21 of the lead frame 2 to prevent the connector casing 1 from disengaging from the lead frame 2. Meanwhile, the ejector 6 is deformed to store elastic return energy as squeezed by the lead frame 2.

Figure 4:
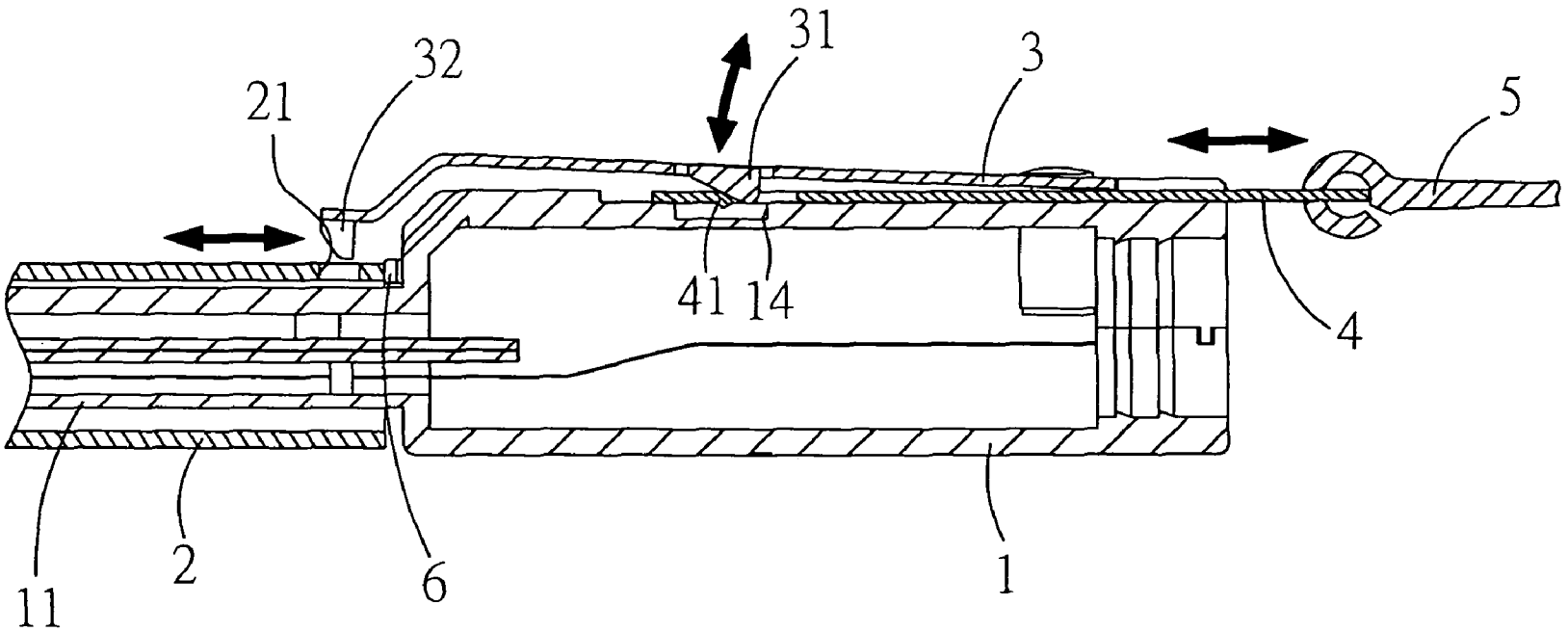
FIG. 4 is a sectional view showing a structure of the present invention when the latch locking type connector is released from its locked status.
Figure 5:
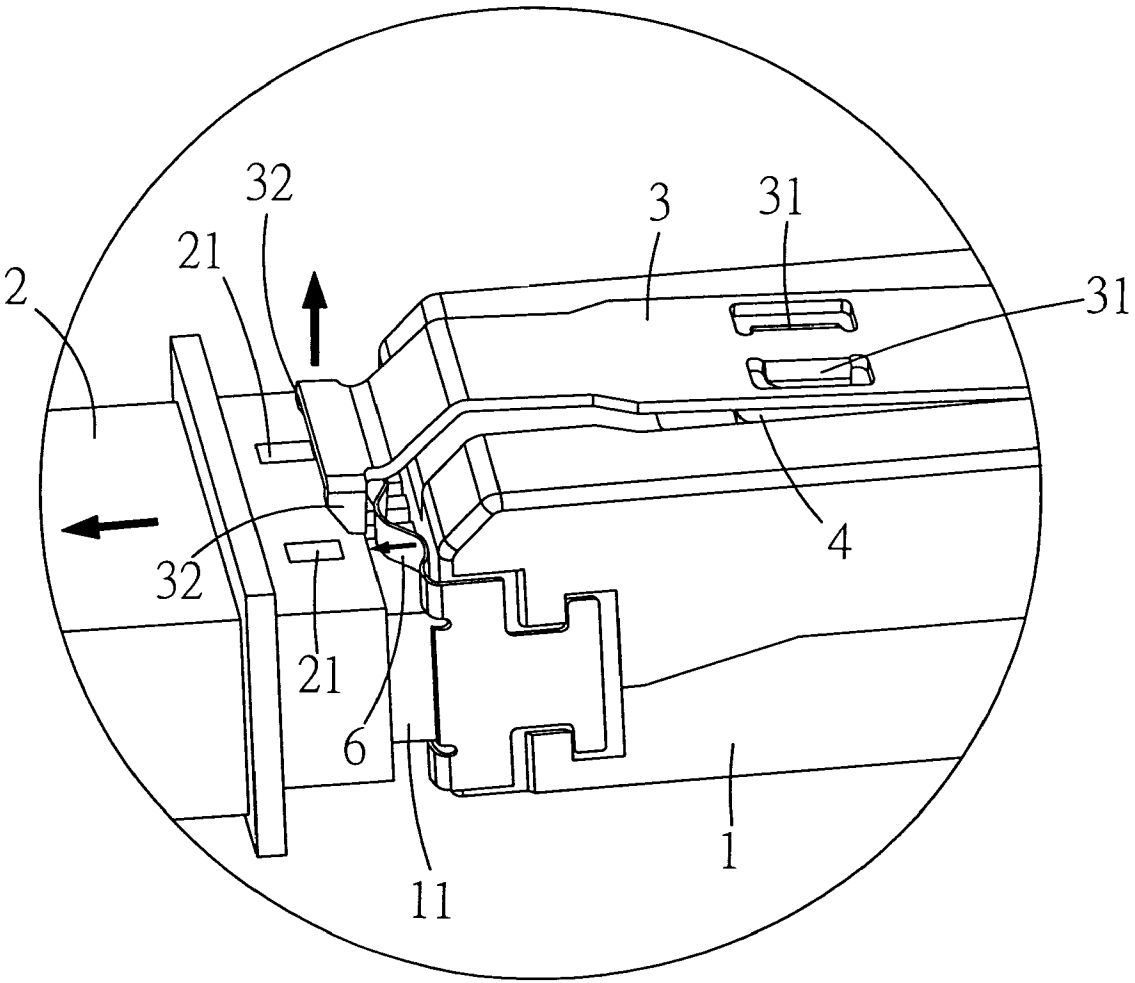
FIG. 5 is a perspective view showing a raised free end of the elastic cantilever of the present invention.

Now referring to FIGS. 4 and 5, when the user pulls the actuation plate 4 to exit the linking hook 32 disposed at the free end of the elastic cantilever 3 from the locking hole 21, the locking limit provided by the lead frame 2 to the connector casing 1 is released for the ejector 6 to return to its original shape for generating the force to separate the connector casing 1 from the lead frame 2. Accordingly, the user is able to easily separate the connector casing 1 from the lead frame 2.

As also illustrated in FIGS. 1 and 2, both of the elastic cantilever 3 and the actuation plate 4 are respectively preferably integrally formed by punching of a piece of sheet metal, and a channel 12 and a stopper 13 to receive insertion of the actuation plate are disposed on the top of the connector casing 1. A notch 42 is disposed on the body of the actuation plate 4 for the stopper to extend into for limiting a sliding travel by the actuation plate 4 so to avoid damaging the actuation plate 4 due to any potential excessive pull the actuation plate 4 may be subject to. A recess 14 for both the inclined plate 31 and the slide 41 extends into and is disposed on the top of the connector casing 1 for reducing a height of the connector in general in order to meet compact design requirements of the latch locking type connector.

The present invention provides a structure of a latch locking type connector, and the application for a patent is duly filed accordingly. However, it is to be noted that the preferred embodiments disclosed in the specification and the accompanying drawings do not limit the present invention; and that any construction, installation, or characteristics that is the same or similar to that of the present invention should fall within the scope of the purposes and claims of the present invention.

I claim:

1. A latch locking type connector comprising:

a connector casing and a lead frame, the connector casing being disposed with an abutting end to be relatively inserted into the lead frame, one or a plurality of locking hole being disposed on a top of the lead frame;

an elastic cantilever with a fixed end being fixed to the connector casing, an elastic end of the elastic cantilever extending in opposite direction toward the abutting end of the connector casing, one or a plurality of inclined plate being disposed on a body of the elastic cantilever, a linking hook corresponding to the locking hole being disposed on an elastic end, and the linking hook extending into the locking hole to prevent the connector casing and the lead frame from falling off; and an actuation plate disposed between the connector casing and the elastic cantilever, the actuation plate has two ends, a one end and an other end, the one end of the actuation plate extending from the connector casing to be pulled by a user for the actuation plate to slide in relation to the elastic cantilever, a slide corresponding to the inclined plate on the elastic cantilever being disposed on a body of the actuation plate, upward movement of the inclined plate resulting from the sliding contact of the slide and the inclined plate raising a free end of the elastic cantilever to exit the linking hook from the locking hole.

2. The latch locking type connector as claimed in claim 1, wherein one or a plurality of ejector is disposed at a root of the abutting end on the connector casing to produce a force to separate the connector casing from the lead frame.

3. The latch locking type connector as claimed in claim 1, wherein a channel to receive insertion of the actuation plate is disposed on a top of the connector casing.

4. The latch locking type connector as claimed in claim 1, wherein a stopper protrudes from the top of the connector casing, wherein a notch to receive extension of the stopper is disposed on a body of the actuation plate to limit sliding travel of the actuation plate.

5. The latch locking type connector as claimed in claim 1, wherein the top of the connector casing is disposed with a recess for both the inclined plate and the slide to extend into.

6. The latch locking type connector as claimed in claim 1, wherein a pull ring is connected to the actuation plate of the connector casing at the one end and the other end of the actuation plate extends into the connector casing.

7. The latch locking type connector as claimed in claim 1, wherein the elastic cantilever is made by pressing a sheet metal into an integrated part.

8. The latch locking type connector as claimed in claim 1, wherein the actuation plate is made by pressing a sheet metal into an integrated part.

9. The latch locking type connector as claimed in claim 1, wherein the elastic cantilever and the actuation plate are respectively made by having a sheet metal punched into an integrated part.

* * * * *